US006638706B2

(12) United States Patent
Matsumura

(10) Patent No.: US 6,638,706 B2
(45) Date of Patent: Oct. 28, 2003

(54) PHOTOTHERMOGRAPHIC RECORDING MATERIAL

(75) Inventor: Toshiyuki Matsumura, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/126,083

(22) Filed: Apr. 18, 2002

(65) Prior Publication Data

US 2003/0087211 A1 May 8, 2003

(30) Foreign Application Priority Data

May 8, 2001 (JP) ..... 2001-137244

(51) Int. Cl.[7] ..... G03C 1/498

(52) U.S. Cl. ..... 430/619; 430/264; 430/599; 430/620

(58) Field of Search ..... 430/619, 264, 430/598, 620

(56) References Cited

U.S. PATENT DOCUMENTS 5,654,130 A * 8/1997 Murray ..... 430/350

FOREIGN PATENT DOCUMENTS

EP 0921433 * 6/1999 ..... G03C/1/498

* cited by examiner

*Primary Examiner*—Thorl Chea
(74) *Attorney, Agent, or Firm*—Frishauf, Holtz, Goodman & Chick, P.C.

(57) ABSTRACT

A photothermographic recording material comprising on one side of a support an image recording layer comprising a light-insensitive organic silver salt, a photosensitive silver halide, a reducing agent for silver ions and a binder, wherein the difference in specular glossiness at an angle of 60° between a thermally developed exposed area of the image recording layer and the bottom support surface opposite the exposed area of the recording material is at least 15.

6 Claims, No Drawings

PHOTOTHERMOGRAPHIC RECORDING MATERIAL

FIELD OF THE INVENTION

The present invention relates to a photothermographic recording material and in more detail to a photothermographic recording material which exhibits improved distinguishability between the front and the back surface.

BACKGROUND OF THE INVENTION

Heretofore, in the graphic arts and medical fields, effluent resulting from wet processing for image forming materials has caused problems with workability. In recent years, from the viewpoint of environmental protection as well as space saving, a decrease in said processing effluent has been increasingly demanded. As a result, techniques have been needed, which relate to photothermographic materials which can be efficiently exposed employing laser image setters and laser imagers, and can form clear black-and-white images exhibiting high resolution.

Said techniques are described in, for example, U.S. Pat. Nos. 3,152,904 and 3,487,075, as well as Morgan et al., "Dry Silver Photographic Materials" in Handbook of Imaging Materials, published by Marcel Dekker Inc., page 48, 1991. Further, photothermographic recording materials (hereinafter simply referred to as recording materials) are known, which comprise a support having thereon organic silver salts, light-sensitive silver halide grains, reducing agents, and binders.

Said photothermographic recording materials form photographic images utilizing heat development and comprise reducible silver sources (being organic silver salts), light-sensitive silver halides, reducing agents, and if desired, image color control agents which control the color of silver images, which are commonly dispersed into an (organic) binder matrix. Said photothermographic recording materials are stable at room temperature. However, when, after image exposure, they are heated to a relatively high temperature (for example, 80 to 140° C.), images are formed by development. When heated, silver is formed through an oxidation-reduction reaction between said organic silver salts (which work as oxidizing agents) and said reducing agents. The rate of said oxidation-reduction reaction is enhanced by the catalytic action of a latent image which has been formed by exposed silver halides. Silver, which is formed through the reaction of organic silver salts in the exposed area, provides a blackened image portion, while the unexposed area remains as it is, whereby an image is formed. Said reaction proceeds without supply of any processing solutions such as water.

When these photothermographic recording materials are employed as graphic arts materials, after heat development, a press plate is commonly exposed through the resultant material and is employed for printing. When said exposure to the press plate is carried out, the front and the back of said photothermographic material are distinguished. However, when distinguishability between the front and the back surface is difficult, namely the front and the back surface exhibiting no visual difference, sufficient care is required for ascertaining that. As a result, a decease in work efficiency results.

SUMMARY OF THE INVENTION

From the viewpoint of the foregoing, the present invention was achieved. It is an object of the present invention to provide a photothermographic recording material which exhibits excellent distinguishability between the front and the back surface and increases efficiency of press-plate making work.

The object of the present invention has been achieved employing the following embodiments.

(1) A photothermographic recording material comprising on one side of a support an image recording layer comprising a light-insensitive organic silver salt, a photosensitive silver halide, a reducing agent for silver ions and a binder, wherein the difference in specular glossiness at an angle of 60° between a thermally developed exposed area of the image recording layer and the bottom support surface opposite the thermally developed exposed area is at least 15.

(2) The photothermographic recording material of item (1), wherein the specular glossiness of the thermally developed exposed area of the image recording layer is smaller than the specular glossiness of the bottom support surface opposite the thermally developed exposed area.

(3) The photothermographic recording material of item (1), wherein the image recording layer further comprises a high contrast agent represented by Formula (1), Formula (1):

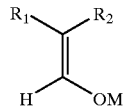

wherein each $R_1$ and $R_2$ is independently a substituent group and at least one of $R_1$ and $R_2$ represents a cyano group; and M represents H or an alkali metal atom.

(4) The photothermographic recording material of item (1), wherein the image recording layer further comprises a high contrast agent represented by Formula (2), Formula (2):

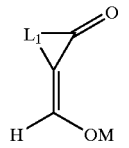

wherein $L_1$ represents a divalent organic group which is capable of forming a ring; and M represents H or an alkali metal atom.

(5) The photothermographic recording material of item (1), wherein the recording material further comprises an adjacent layer in direct contact with the image recording layer, and at least one of the image recording layer and the adjacent layer comprises a high contrast agent represented by Formula (1), Formula (1):

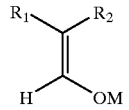

wherein each $R_1$ and $R_2$ is independently a substituent group and at least one of $R_1$ and $R_2$ represents a cyano group; and M represents H or an alkali metal atom.

(6) The photothermographic recording material of item (1), wherein the recording material further comprises an adjacent layer in direct contact with the image recording layer, and at least one of the image recording layer and the second layer comprises a high contrast agent represented by Formula (2), Formula (2):

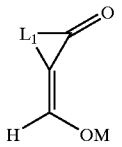

wherein $L_1$ represents a divalent organic group which is capable of forming a ring; and M represents H or an alkali metal atom.

DETAILED DESCRIPTION OF THE INVENTION

The present invention will now be detailed.

The invention according to item (1) is characterized in that specular glossiness difference (in terms of an absolute value) between the surface of a blackened area after development on the side which is coated with an image recording layer and the surface on the side which is not coated with said image recording layer is at least 15 at a measured angle of 60 degrees. Further, the invention according to item (2) is characterized in that glossiness difference between the surface of a blackened area after development on the side (hereinafter occasionally referred to as an image recording layer side), which is coated with an image recording layer, and the surface on the side, which is not coated with said image recording layer, is at least 15 at a measured angle of 60 degrees, and in addition, glossiness of the surface on the side (hereinafter occasionally referred to as a backing layer side) which is not coated with said image recording layer is greater than that of the surface on the side coated with said image recording layer.

The specular glossiness at a measured angle of 60 degrees, as described in the present invention, refers to the value determined in accordance with JIS Z8741, and is expressed by glossiness with respect to a glass surface at an incident angle of 60 degrees. ISO 2813:1994 is a International Standard which corresponds to JIS Z8741. The title of ISO 2813 is "Paints and varnishes–Determination of specular gloss of non-metallic paint films at 20°, 60° and 85°". Even though the glossiness of the image recording layer side in the present invention is not definitely determined due to the fact that relative glossiness with the backing layer side is taken into account, said glossiness is preferably from 40 to 70, is more preferably from 45 to 65, and is most preferably from 50 to 60. Further, even though glossiness of the backing layer side is also not definitely determined due to the fact that the relative glossiness with the image recording layer side is taken into account, said glossiness is preferably from 55 to 100, is more preferably from 70 to 95, and is most preferably from 80 to 95. It is characterized that the absolute value of glossiness difference between the image recording layer side and the backing layer side is at least 15. Further, said difference is preferably from 15 to 50, is more preferably from 20 to 45, and is most preferably from 25 to 45.

The glossiness in accordance with the present invention can be determined, employing for example, a glossmeter GM-268, manufactured by Minolta Co., Ltd., a digital variable angle glossmeter Type UGV-5D, manufactured by Suga Shikenki Co., Ltd., or a digital variable angle glossmeter Type VG-1D, manufactured by Nihon Denshoku Kogyo Co., Ltd.

In order to adjust the front and the back of recording materials to the desired glossiness, there are a method in which fine particles are incorporated into a layer, and a method in which minute phase separation is generated by employing a plurality of polymers as binders. However, theses methods are not particularly limited. One of the simplest methods in the present invention is that by suitably selecting the shape, particle diameter, or added amount of matting agents which, are added to the image recording layer side as well as the backing layer side, it is possible to obtain the desired glossiness of each layer side.

Another method, which controls the glossiness of both sides of said recording material, includes one in which minute phase separation is performed by employing a plurality of polymers as binders. In said method, a plurality of resins is blended with resins which constitute the uppermost layer, and the resultant glossiness is adjusted utilizing phase separation. The type of blending resins used is not particularly limited. However, depending on said blended resins, the following cases may occur. Said phase separation is not noted at all whereby no effects on glossiness are exhibited. Said phase separation occurs excessively, whereby haze and/or coatability degradation occur.

Listed as one example of the preferred combination of a plurality of resins to control glossiness is a combination of cellulose acetate butyrate and cellulose acetate propionate. Compared to the case in which both resins are employed individually, when both resins are blended, the resultant glossiness is lowered to result in an effective measure to distinguish between the front and the back surface. The blending ratio of both resins is preferably from 10:90 to 90:10, and is more preferably from 20:80 to 80:20.

Matting agents usable in the present invention will now be detailed.

The materials of matting agents usable in the present invention may be either organic or inorganic. Employed as inorganic materials may be, for example, silica described in Swiss Patent No. 330,158, glass powder described in French Patent No. 1,296,995, and carbonates of alkali earth metal or cadmium and zinc described in British Patent No. 1,173,181. Employed as organic matting agents are starch described in U.S. Pat. No. 2,322,037; starch derivatives described in Belgian Patent No. 625,451 and British Patent No. 981,198; polyvinyl alcohol described in Japanese Patent Publication No. 44-3643; polystyrene or polymethacrylate described in Swiss Patent No. 330,158; polyacrylonitrile described in U.S. Pat. No. 3,022,169; and polycarbonate described in U.S. Pat. No. 3,022,169.

The form of matting agents may be either regular or irregular, but a regular form is preferred, and a spherical shape is preferably employed. The particle size of said matting agents is expressed by the diameter of a sphere which has the same volume as the particle. The particle diameter of said matting agents, as described in the present invention, is to be the diameter of a sphere which has the same volume as that of said particle.

The average particle diameter of the matting agents, employed in the present invention, is preferably from 0.5 to 20 $\mu$m, and is more preferably from 1.0 to 15.0 $\mu$m. Further, the variation coefficient of the particle size distribution is preferably 50 percent or less, is more preferably 40 percent or less, and is most preferably 30 percent or less.

Herein, the variation coefficient of the particle size distribution is the value represented by the formula given below:

{(standard deviation of particle diameter)/(average of particle diameter)}×100.

In the present invention, the content ratio of matting agents incorporated into the image recording layer side is preferably from 0.2 to 10 percent by weight with respect to the total solids of the image recording layer side, or alternatively the added amount is preferably 40 to 800 mg per Further, the content ratio of matting agents incorporated into the backing layer side is preferably from 0.1 to 5 percent by weight with respect to the total solids of the backing layer side, or alternatively the added amount is preferably 4 to 200 mg per $m^2$.

In the present invention, said matting agents may be incorporated into any of the constituted layers. However, in order to achieve the objectives of the present invention, on the image recording layer side, layers other than the image recording layer are preferred, and the outermost layer from the support, namely the protective layer, is more preferred. Further, on the backing layer side, addition is preferably carried out on the outermost layer from the support, namely the protective layer.

In the present invention, methods for adding said matting agents include a method in which said matting agents are previously dispersed into a coating composition followed by coating the resultant composition, and a method in which after coating a coating composition, said matting agents are sprayed onto the coating prior to its drying. Further, when a plurality of matting agents is applied, both methods may be used in combination.

In addition to the aforesaid methods, other methods, which may be employed to adjust said glossiness, include, for example, a calender roller treatment applied to the coating surface, coating of a filler containing overcoat layer, coating of foaming resins, minute embossing, mechanical polishing utilizing an abrasive dispersion treatment, and mechanical polishing utilizing a brush. A suitable method may be selected from these and employed, or some of these may be employed in combination.

Contrast increasing agents, represented by Formula (1) or (2), will now be described.

The invention according to items (3) and (5) is characterized in that an image recording layer or its adjacent layer comprises the contrast increasing agents represented by the aforesaid Formula (1).

The contrast increasing agents represented by Formula (1) will now be detailed.

In the aforesaid Formula (1), at least one of $R_1$ and $R_2$ represents a cyano group and the alternate represents an optional univalent substituent. M represents a hydrogen atom or an alkali metal atom.

In Formula (1), cited as univalent groups are, for example, an alkyl group, an alkenyl group, an alkynyl group, an aryl group, a heterocyclic ring group, a quaternary nitrogen atom-containing heterocyclic group (for example, pyridinium group), a hydroxy group, an alkoxy group (for example, including a group which contains repeated units of an ethyleneoxy group or a propyleneoxy group), an aryloxy group, an acyloxy group, an acyl group, an alkoxycarbonyl group, an aryloxycarbonyl group, a carbamoyl group, a urethane group, a carboxyl group, an imido group, an amino group, a carboxamido group, a sulfonamido group, a ureido group, a thioureido group, a sulfamoylamino group, a semicarbazido group, a thiosemicarbazido group, a hydorazino group, a quaternary ammonia group, an alkylthio group, an arylthio group, a heterocyclic thio group, a mercapto group, an alkylsulfonyl group, an arylsulfonyl group, an alkylsulfinyl group, an aryl sulfinyl group, a sulfo group, a sulfamoyl group, an acylsulfamoyl group, an alkylsulfonylureido group, an arylsulfonylureido group, an alkylsulfonylcarbamoyl group, an arylsulfonylcarbamoyl group, a halogen atom, a cyano group, a nitro group, and a phosphoric acid amido group.

Further, listed as alkali metal atoms are sodium and potassium.

The preferred specific examples of contrast increasing agents represented by Formula (1) according to the present invention will now be illustrated. However, the present invention is not limited to these examples.

1-1

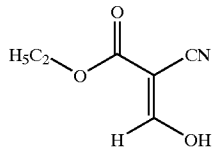

1-2

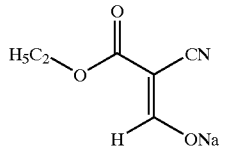

1-3

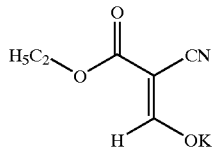

1-4

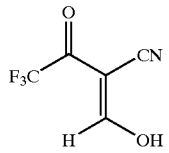

1-5

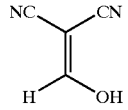

1-6

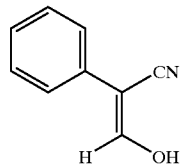

1-7

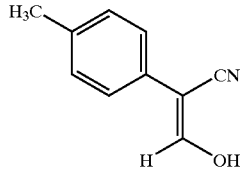

-continued 1-8

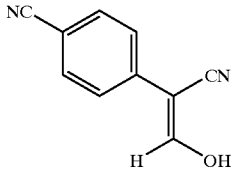

1-9

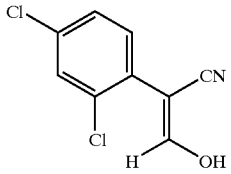

1-10

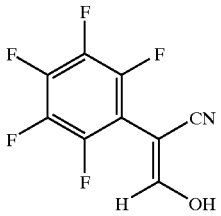

The compounds represented by Formula (1) of the present invention, when incorporated into said image recording layer or its adjacent layer, function as contrast increasing agents and are capable of more effectively exhibiting the desired effects of the present invention.

The amount of the compounds added, represented by Formula (1), is preferably in the range of 0.001 to 0.3 mol per mol of silver atom incorporated into the image recording layer, and is more preferably in the range of 0.005 to 0.05 mol.

One of the features of the invention according to items (4) and (6) is that an image recording layer or its adjacent layer comprises the contrast increasing agents represented by the aforesaid Formula (2).

The contrast increasing agents represented by Formula (2) will now be detailed.

In aforesaid Formula (2), M represents a hydrogen atom or an alkali metal atom and L represents a divalent organic group necessary for forming a cyclic ring structure.

$L_1$ in Formula (2) represents an individual group or combination of, for example, an alkylene group (for example, a methylene group, an ethylene group, a 1,2-propylene group, a 1,4-butylene group, and a 1,2-cyclohexylene group), an arylene group (for example, a 1,2-phenylene group, a 1,3-phenylene group, a 1,4-phenylene group, a 1,2-naphthylene group, and a 9,10-anthranylene group), an alkenylene group, —$SO_2$—. —SO—, —O—, —S—, —CO—, and —N($R_3$)—, wherein $R_3$ represents an alkyl group, an aryl or a hydrogen atom).

Further, cited as alkali metal atoms are sodium and potassium.

The preferred specific examples of contrast increasing agents represented by Formula (2) according to the present invention will be demonstrated below. However, the present invention is not limited to these examples.

2-1

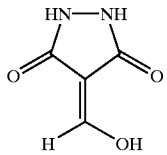

2-2

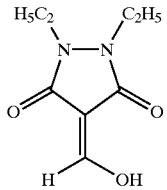

2-3

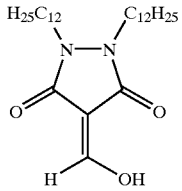

2-4

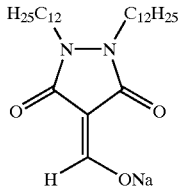

2-5

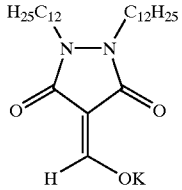

2-6

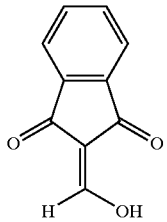

2-7

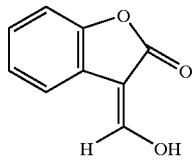

2-8

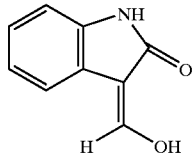

-continued 2-9

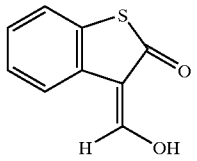

2-10

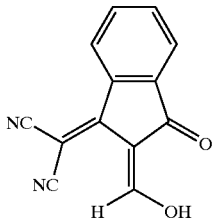

2-11

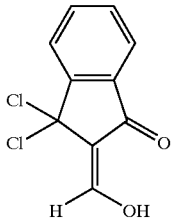

2-12

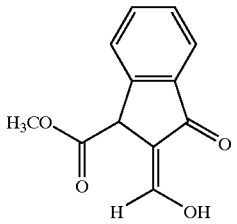

The compounds represented by General Formal (2) of the present invention, when incorporated into said image recording layer or its adjacent layer, function as contrast increasing agents and are capable of more effectively exhibiting the desired effects of the present invention.

The amount of the compounds added, represented by Formula (2), is preferably in the range of 0.001 to 0.3 mol per mol of silver atom incorporated into the image recording layer, and is more preferably in the range of 0.005 to 0.05 mol.

In the present invention, other than the contrast increasing agents represented by aforesaid Formula (1) or (2), other contrast increasing agents, known in the art, may be employed individually or in combination.

Listed as other contrast increasing agents usable in the present invention may be those described in Research Disclosure (hereinafter referred to as RD) 23515 (November 1983, page 346) and references cited therein; and U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355, and 5,104,769; British Patent No. 2,011,391B; European Patent Nos. 217,310, 301,799, and 356,898; Japanese Patent Publication Open to Public Inspection Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524, and 9-160164.

In addition to these compounds, employed may be compounds represented by (Ka 1) described in Japanese Patent Publication No. 6-77138, specifically including compounds on pages 3 and 4; compounds represented by Formula (1) in Japanese Patent Publication No. 6-93082, specifically including compounds 1 through 38 on pages 8 to 18; compounds represented by Formulas (4), (5), and (6) described in Japanese Patent Publication Open to Public Inspection No. 6-23049, including compounds 4-1 through 4-10 described on pages 25 and 26, compounds 5-1 through 5-42 on pages 28 through 36, and compounds 6-1 through 6-7 on pages 39 and 40; compounds represented by Formulas (1) and (2) described in Japanese Patent Publication Open to Public Inspection No. 6-289520, specifically including compounds 1-1) through 1-17) and 2-1) on pages 5 through 7; compounds represented by (Ka 2) and (Ka 3) described in Japanese Patent Publication Open to Public Inspection No. 6-313936, specifically including compounds on pages 6 through 19; compounds represented by (Ka 1) described in Japanese Patent Publication Open to Public Inspection No. 6-313951, specifically including compounds on pages 3 through 5; compounds represented by Formula (I) described in Japanese Patent Publication Open to Public Inspection No. 7-5610, specifically including compound 1-1 through I-38 on pages 5 through 10; compounds represented by Formula (II) described in Japanese Patent Publication Open to Public Inspection No. 7-77783, specifically including compounds II-1 through II-102 on pages 10 through 27; and compounds represented by Formulas (H) and (Ha) described in Japanese Patent Publication Open to Public Inspection No. 7-104426, specifically including compounds H-1 through H-44 on pages 8 through 15.

Each of the components, other than those described above, of the photothermographic materials employed in the present invention, will now be described.

In the photothermographic materials employed in the present invention, the following materials are preferably employed by adding any of those to the constitution of the present invention: silver halides described in paragraphs [0089] through [0101] of Japanese Patent Publication Open to Public Inspection No. 2001-56521; organic silver salts described in paragraphs [0135] and [0136] of Japanese Patent Publication Open to Public Inspection No. 2001-13661: reducing agents described in paragraphs [0125] through [0131] of Japanese Patent Publication Open to Public Inspection No. 2000-310832; binders described in paragraphs [0142] through [0145] of Japanese Patent Publication Open to Public Inspection No. 2000-310832; retarding agents described in paragraphs [0070] through [0088] of Japanese Patent Publication Open to Public Inspection No. 2001-56521; color controlling agents described in paragraphs [0111] through [0113] of Japanese Patent Publication Open to Public Inspection No. 2001-56521: dyes described in paragraph [0116] of Japanese Patent Publication Open to Public Inspection No. 2000-310832; dyes described in paragraph [0116] of Japanese Patent Publication Open to Public Inspection No. 2001-310832; supports, subbing layers, and antistatic layers described in paragraphs [0122] through [0125] of Japanese Patent Publication Open to Public Inspection No. 2001-13660.

Further, various additives may be incorporated into any of the image recording layer, the non-image recording layer, or other layers. Additives such as surface active agents, antioxidants, stabilizers, plasticizers, UV absorbers, and coating aids may be employed in the photothermographic materials of the present invention. Preferably employed as these additives, as well as the aforesaid additives, may be compounds described in RD Item 17029 (June 1978, pages 9 through 15).

EXAMPLES

The present invention will now be detailed with reference to examples. However, the present invention is not limited to these examples.

<<Photothermographic Recording Material 1>>

Sample 1, which was said photothermographic material, was prepared employing the method described below.

(Preparation of Photographic Subbed Film Base)

A commercially available 125 μm thick biaxially stretched thermally fixed PET film was subjected on both sides to a corona discharge treatment of 8 W/m$^2$ minute Subsequently, the subbing coating composition a-1, described below, was applied onto one surface of said film so as to obtain a dried layer thickness 0.8 μm, and the resultant coating was designated as subbing layer A-1. Further, the antistatic subbing layer composition b-1, described below, was applied onto the other surface so as to obtain a dried layer thickness of 0.8 μm. The resultant coating was designated as antistatic subbing layer B-1.

| (Subbing Coating Composition a-1) | |
|---|---|
| Copolymer latex (30 percent solids) of butyl acrylate (30 percent by weight), t-butyl acrylate (20 percent by weight), butylene (25 percent by weight), and 2-hydroxyethyl acrylate (25 percent by weight) | 270 g |
| (C-1) | 0.6 g |
| Hexamethylene-1,6-bis(ethyleneurea) | 0.8 g |
| Fine polystyrene particles (having an average particle diameter of 3 μm) | 0.05 |
| Colloidal silica (having an average diameter of 90 μm) | 0.1 g |
| Water to make | 1 L |
| (Subbing Coating Composition b-1) | |
| $SnO_2$/Sb (ratio by weight of 9/1, having an average particle diameter of 0.18 μm) | amount to obtain 200 mg/m$^2$ |
| Copolymer latex (30 percent solids) of butyl acrylate (40 percent by weight), styrene (20 percent by weight), and glycidyl acrylate (40 percent by weight) | 270 g |
| (C-1) | 0.6 g |
| Hexamethylene-1,6-bis(ethyleneurea) | 0.8 g |
| Water to make | 1 L |

Subsequently, both surfaces of subbing layers A-1 and B-1 were subjected to a corona discharge of 8 W/m$^2$ minute. The subbing upper layer coating composition described below was applied as subbing upper layer A-2 onto said subbing layer A-1 so as to obtain a dried layer thickness of 0.1 μm, while the subbing upper layer coating composition b-2, described below, was applied as subbing upper layer B-2 exhibiting an antistatic function onto said subbing layer B-1 so as to obtain a dried layer thickness of 0.8 μm.

| (Subbing Upper Layer Coating Composition a-2) | |
|---|---|
| Gelatin | weight to result in 0.4 g/m$^2$ |
| (C-1) | 0.2 g |
| (C-2) | 0.2 g |
| (C-3) | 0.1 g |
| Silica particles (having an average diameter of 3 μm) | 0.1 g |
| Water to make | 1 L |
| (Subbing Upper Layer Coating Composition b-2) | |
| (C-4) | 60 g |
| Latex comprising (C-5) as a component (20 percent solids) | 80 g |
| Ammonium nitrate | 0.5 g |
| (C-6) | 12 g |
| Polyethylene glycol (having an average weight molecular weigh of 600) | 6 g |
| Water to make | 1 L |

(C-1)

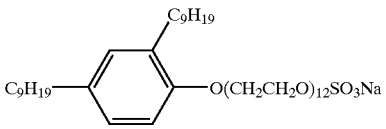

-continued (C-2)

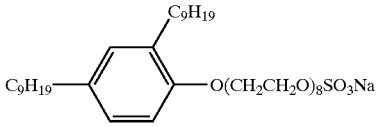

(C-3)

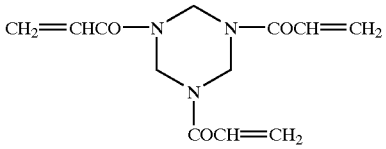

(C-4)

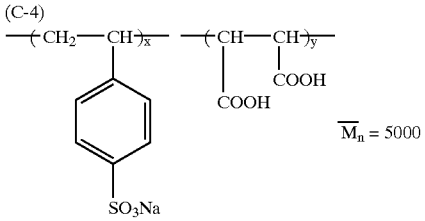

$\overline{M}_n$ = 5000

$\overline{M}_n$ is a number average molecular weight x:y = 75:25 (as a weight ratio)

(C-5)

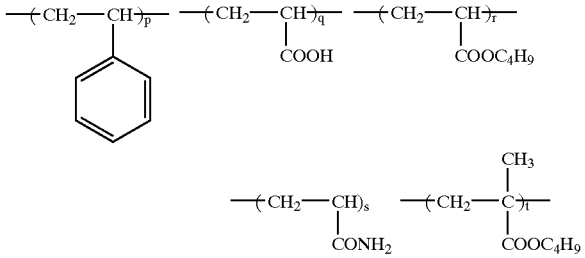

p:q:r:s:t = 40:5:10:5:40 (weight ratio)

(C-6)

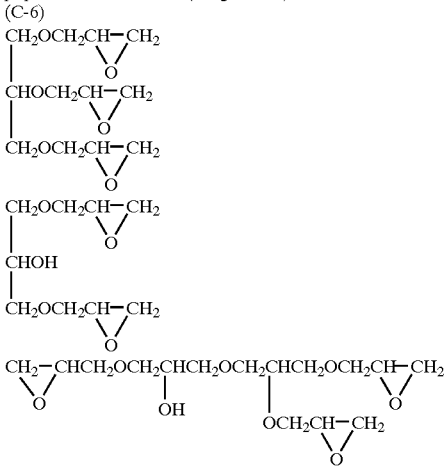

(A mixture of three compounds)

<Thermal Treatment of Support>

In the subbing drying process of the subbed support described above, said support was heated at 140° C., and subsequently gradually cooled. During said operation, conveyance was carried out at a tension of $1\times10^5$ Pa.

(Preparation of Light-Sensitive Emulsion A>

Dissolved in 900 ml of water were 7.5 g of inert gelatin, and 10 mg of potassium bromide, and the temperature and pH of the resultant solution was adjusted to 35° C. and 3.0, respectively. Subsequently, 370 ml of an aqueous solution containing 74 g of silver nitrate, and potassium bromide and potassium iodide at a mole ratio of (98/2) in an amount of the same moles as silver nitrate, and 370 ml of an aqueous solution containing $1\times10^{-6}$ mole of $[Ir(NO)Cl_5]$ and $1\times10^{-6}$ mole of rhodium chloride per mole of silver were added over 10 minutes, employing a double jet method. Thereafter, 4-hydroxy-6-methyl-1,2,3a, 7-tetraazaindene was added and the pH of the resultant mixture was adjusted to 5.0 by adding NaOH, whereby non-monodispersed cubic silver bromoiodide grains were obtained which had an average grain size of 0.06 $\mu$m, a degree of dispersion of 45 percent, and a ratio of [100] plane of 87 percent. The resultant emulsion was coagulated employing a gelatin coagulant which was subjected to desilvering. Thereafter, 0.1 g of phenoxyethanol was added, and the pH and pAg of the resultant mixture was adjusted to 5.9 and 7.5, respectively. Further, the resultant emulsion underwent chemical sensitization utilizing chloroauric acid, inorganic sulfur, thiourea dioxide, and 2,3,4,5-pentafluorophenyldiphenylphosphine selenide, whereby Silver Halide Emulsion A was prepared.

<Preparation of Sodium Behenate Solution>

At 60° C., 32.4 g of behenic acid, 9.9 g of arachidinic acid, and 5.6 g of stearic acid were dissolved in 945 ml of pure water. Under high speed stirring, 98 ml of a 1.5 mol/L aqueous sodium hydroxide solution was added. Subsequently, after adding 0.93 ml of concentrated nitric acid, the resultant mixture was cooled to 55° C. and stirred over 30 minutes, whereby a sodium behenate solution was prepared.

<Preparation of Pre-Form Emulsion A>

Added to the aqueous sodium behenate solution prepared as above was 15.1 g of the aforesaid silver Halide Emulsion A, and the pH of the resultant mixture was adjusted to 8.1 by adding a sodium hydroxide solution. Subsequently, 147 ml of a 1 mole/L silver nitrate solution was added over one minute, and stirred for an additional 15 minutes. Thereafter, water-soluble salts were removed employing ultrafiltration. Prepared silver behenate was comprised of needle-shaped grains having an average long side length of 0.8 μm. After forming a flock of the dispersion, water was removed and washing and water removal were repeated 6 times. The resultant product was then dried, whereby Pre-form Emulsion A was prepared.

<Preparation of Light-Sensitive Emulsion A Containing Organic Silver Salt A>

Gradually added to the prepared Pre-form Emulsion A were 544 g of a methyl ethyl ketone solution (17 percent by weight) of polyvinyl butyral (having an average molecular weight of 3,000) and 107 g of toluene. The resultant mixture was blended and dispersed at 4,000 psi. After dispersion, the resultant organic silver salt particles were observed employing an electron microscope. As a result, said grains were found to be monodispersed organic silver salt grains having an average particle diameter of 0.7 mg and a degree of dispersion of 60 percent. Further, after coating and drying said grains, the resultant organic silver salt grains were observed in the same manners as above, and it was possible to confirm them as the same particle as before. Subsequently, 4.7 ml of a 0.01 percent methanol solution of calcium bromide was added to 240 g of said emulsion, whereby Light-Sensitive Emulsion A was prepared. Silver halide grains in said emulsion were observed employing an electron microscope. It was noted that silver halide grains of a diameter of 0.01 μm or less were not observed.

(Coating on Backing Layer Surface Side)

Each of backing layer coating composition 1 and back protective layer coating composition 1, having the composition described below, was filtered employing a semi-absolute filtration accuracy of 20 μm. Subsequently, each of the filtrates was applied onto the antistatic subbing upper layer B-2 at a speed of 120 m per minute employing an extrusion coater so as to obtain a total wet layer thickness of 30 μm and subsequently dried at 60° C. over 4 minutes.

| (Backing Layer Coating Composition 1) | |
|---|---|
| Cellulose acetate butyrate (10 percent methyl ethyl ketone solution) | 15 ml/m$^2$ |
| Tomisorb 77 (hindered amine, manufactured by Yoshitomi Seiyaku Co., Ltd.) | 20 mg/m$^2$ |
| Dye A | 7 mg/m$^2$ |
| Dye B | 7 mg/m$^2$ |
| (Back Protective Layer Coating Composition 1) | |
| Cellulose acetate butyrate (10 percent methyl ethyl ketone) | 5 ml/m$^2$ |
| Matting agent M3 (irregular-shaped silica particles having an average grain diameter of 10 μm and a particle size distribution variation coefficient of 22 percent) | 20 mg/m$^2$ |
| Compound 1 (*1) | 10 mg/m$^2$ |
| Fluorine based surface active agent: $C_8F_{17}(CH_2CH_2O)_{22}C_8F_{17}$ | |

Dye A

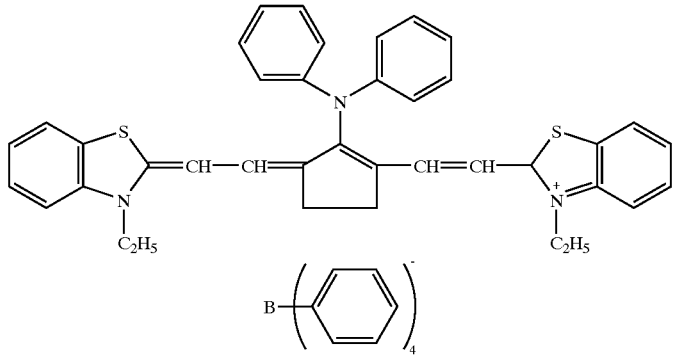

-continued

Dye B

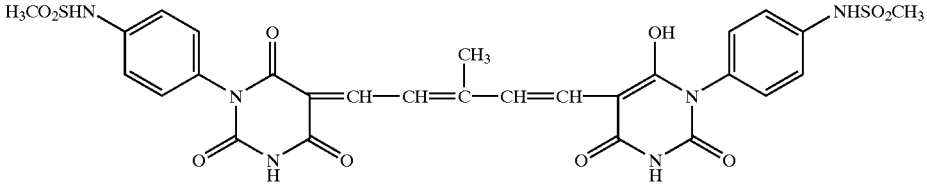

(*1): Compound 1 $(CH_3)_3SiO—[(CH_3)_2SiO]_{20}—[(CH_3SiO\{CH_2CH_2CH_2O(CH_2CH_2O)_{10}(CH_2CH_2CH_2O)_{15}CH_3\})_{30}—Si(CH_3)_3$ (Coating on the Image Recording Layer Surface Side)

One each of an image recording layer coating composition and a surface protective layer coating composition, having the composition described below, was filtered employing a filter having a semi-absolute filtration accuracy of 20 μm. Subsequently, said surface protective layer composition and said image recording layer coating composition in said order were applied onto the surface of the aforesaid subbing upper layer A-2 at a speed of 100 m/minute, employing an extrusion coater, whereby Sample 1 was prepared.

Said coating was carried out so as to obtain a coated silver amount of 1.5 g/m$^2$. Thereafter, the resultant coating was dried at 65° C. for one minute.

| (Image Recording Layer Coating Composition) | |
|---|---|
| Light-sensitive emulsion A | 240 g |
| Sensitizing dye (0.1 percent methanol solution) | 1.7 ml |
| 2-(4-chlorobenzoyl)benzoic acid (12 percent methanol solution) | 9.2 ml |
| 2-mercaptobenzimidazole (1 percent methanol solution) | 11 ml |
| Contrast increasing agent: Exemplified Compound 2–3 | 0.5 g |
| Compound 2 | 0.5 g |
| Compound 3 | 0.4 g |
| Compound 4 (20 percent methanol solution) | 29.5 ml |
| Phthalazine | 0.2 g |
| 4-methylphthalic acid | 0.25 g |
| Tetrachlorophthalic acid | 0.2 g |
| Polyester-polyurethane compound (UR8300 having an average molecular weight of 39,000, manufactured by Toyobo Co.) | 20 g |
| Alkoxysilane compound: Ph-NH—$(CH_2)$—Si—$(OCH_3)_3$ | 1 g |
| (Surface Protective Layer Coating Composition) | |
| Acetone | 5 ml/m$^2$ |
| Methyl ethyl ketone | 21 ml/m$^2$ |
| Cellulose acetate butyrate | 2.3 g/m$^2$ |
| Methanol | 7 ml/m$^2$ |
| Phthalazine | 250 mg/m$^2$ |
| Matting agent M1 (irregular-shaped silica particles having an average diameter of 3.5 μm and a particle size distribution variation coefficient of 28 percent) | 100 mg/m$^2$ |
| Vinylsulfone compound: VS-1 | 35 mg/m$^2$ |
| Fluorine based surface active agent: $C_{12}F_{25}(CH_2CH_2O)_{10}C_{12}F_{25}$ | 10 mg/m$^2$ |

Sensitizing Dye

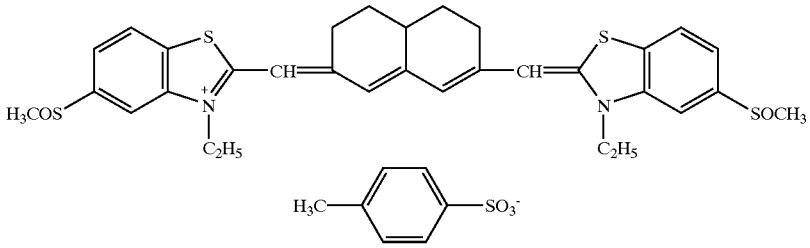

Vinylsulfone Compound VS-1

$CH_2=CHSO_2CH_2CH_2OCH_2CH_2SO_2CH=CH_2$

-continued

Compound 2

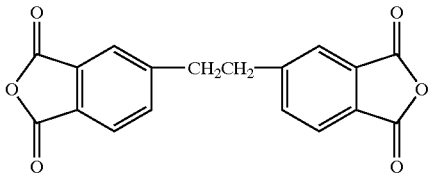

Compound 3

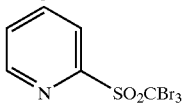

Compound 4

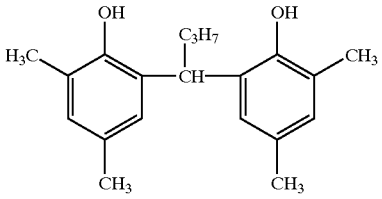

As described above, Sample 1, a photothermographic recording material, which was constituted as shown in Table 1, was prepared.

types of contrast increasing agents of the image recording layer coating composition, were altered as described in Table 1.

TABLE 1

| Sample No. | Contrast Increasing Agent of Image Recording Layer | Matting Agent of Surface Protective Layer | | Matting Agent of Backing Protective Layer | | Maximum Density |
|---|---|---|---|---|---|---|
| | | Type | Added Amount (in mg/m$^2$) | Type | Added Amount (in mg/m$^2$) | |
| 1 | 2-3 | M1 | 100 | M3 | 20 | 4.1 |
| 2 | 2-7 | M2 | 100 | M4 | 15 | 4.5 |
| 3 | 1-8 | M2 | 80 | M4 | 20 | 4.5 |
| 4 | 2-8 | M3 | 80 | M4 | 30 | 4.1 |
| 5 | 2-11 | M2 | 100 | M3 | 20 | 4.2 |
| 6 | 1-7 | M3 | 100 | M3 | 20 | 4.2 |
| 7 | — | M3 | 100 | M3 | 20 | 2.1 |
| 8 | 1-1 | M3 | 60 | M3 | 30 | 4.9 |
| 9 | 2-7 | M3 | 100 | M1 | 100 | 4.5 |
| 10 | 2-7 | — | — | — | — | 4.5 |

| Sample No. | Glossiness | | | Error Ratio | Remarks |
|---|---|---|---|---|---|
| | Glossiness Ga of Image Recording Layer Side | Glossiness Gb of Backing Layer Side | Glossiness Difference (\|Gb − Ga\|) | | |
| 1 | 45 | 83 | 38 | 0% | Present Invention |
| 2 | 52 | 94 | 42 | 0% | Present Invention |
| 3 | 60 | 89 | 29 | 0% | Present Invention |
| 4 | 63 | 79 | 16 | 2% | Present Invention |
| 5 | 51 | 86 | 35 | 0% | Present Invention |
| 6 | 55 | 85 | 30 | 0% | Present Invention |
| 7 | 64 | 84 | 20 | 12% | Present Invention |
| 8 | 70 | 83 | 13 | 100% | Comparative Example |
| 9 | 45 | 43 | 2 | 100% | Comparative Example |
| 10 | 102 | 98 | 4 | 100% | Comparative Example |

<<Preparation of Photothermographic Recording Material Samples Through 10>>

Samples 2 through 10 were prepared in the same manner as said Sample 1, except that the types and added amount of the back protective layer coating composition and the surface protective layer coating composition, as well as the Incidentally, details of each of the matting agents (excluding M1 and M3) in Table 1 are as follows:

Matting Agent M2: irregular shaped silica particles, average particle diameter of 5.0 μm, and particle size distribution variable coefficient of 28 percent Matting Agent M4: spherical silica, average particle diameter of 12 μm, and particle size distribution variable coefficient of 18 percent.

<<Exposure and Heat Development of Each Sample>>

Each of the photothermographic materials prepared as above was subjected to exposure on the image recording layer side through a wedge, employing an exposure device which employed, as an exposure source, a semiconductor laser of a wavelength of 780 nm which was subjected to a longitudinal multi-mode, employing a high frequency superposition method described in Japanese Patent Publication Open to Public Inspection No. 59-130494. Thereafter, the resultant material was subjected to heat development at 122° C. for 18 seconds employing an oven, whereby each of the heat developed recording materials was prepared.

<<Calculation of Each Characteristic Value and Evaluation of Various Types of Performance>>

(Calculation of Maximum Density)

Density of each of the samples developed as above was determined employing an optical densitometer (PD-6, manufactured by Konica Corp.) which was fitted with a filter which absorbed light of a wavelength of at least 420 nm, and subsequently, a characteristic curve was drawn in which the abscissa represented exposure amount (Log E) and the ordinate represented optical density (D). Based on the resultant characteristic curve, the maximum density was determined.

(Evaluation of Specular Glossiness)

Specular glossiness, measured at an angle of 60 degrees, was determined at 10 points in the area exhibiting the maximum density of each of the samples developed as above was determined employing a glossmeter GM-268, manufactured by Minolta Co., and subsequently, the average was obtained, which was designated as image recording layer side glossiness Ga. Subsequently, glossiness of the maximum density area on the backing surface side was determined in the same manner, which was designated as backing layer side glossiness Gb. Then, glossiness difference, (═Gb−Ga═), was calculated.

(Evaluation of Distinguishability Between the Front and the Back)

With regard to 5 sheets of each of the samples developed as above, distinguishability between the front and the back was visually evaluated based on the criteria described below.

Evaluation of Distinguishability Between the Front and the Back Surface: Error Ratio Employing developed samples, each of said samples was 100 times printed onto a PS printing plate. Frequency in which back printing was carried out due to erroneous discrimination between the front and the back surface was designated as an error ratio and compared to each other. In that case, recorded images were not referred to as a means to distinguish between the front and the back surface. For example, 1 percent error ratio refers to the case in which said back printing was carried out one time among 100 printing cycles. Further, when it was substantially impossible to distinguish between the front and the back surface, said error ratio was designated as 100 percent.

The results obtained above are shown in Table 1.

As can clearly be seen from Table 1, samples, which exhibited a glossiness difference, between the image recording layer side and the backing layer side, of at least 15 exhibited excellent distinguishability between the front and the back, compared to Comparative Examples. Further, it was clearly seen that by incorporating the contrast increasing agents represented by General Formal (1) or (2) according to the present invention into the image recording layer, a higher maximum density was realized and distinguishability between the front and the back surface was further improved.

Samples were prepared by varying 2.3 g/m$^2$ of cellulose acetate butyrate in the composition of said surface protective layer to the composition shown in Table 2, using the structure of Sample No. 8 shown in Table 1. The maximum density, glossiness, and error ratio of the resultant samples were determined in the same manner as above. Table 2 shows the obtained results.

TABLE 2

| Sample No. | | Maximum Density | Glossiness: Image Recording Surface Side Glossiness Ga | Glossiness: Backing Layer Surface Side Glossiness Gb | Glossiness Difference (\|Gb − Ga\|) | Error Ratio | Remarks |
|---|---|---|---|---|---|---|---|
| 11 | Cellulose acetate butyrate (CAB381-20*) 1.8 g/m$^2$ Cellulose acetate propionate (CAP504-0.2*) 0.5 g/m$^2$ | 4.9 | 66 | 83 | 17 | 2% | Inv. |
| 12 | Cellulose acetate butyrate (CAB381-20) 1.3 g/m$^2$ Cellulose acetate propionate (CAP504-0.2) 1.0 g/m$^2$ | 4.9 | 61 | 83 | 22 | 0% | Inv. |

TABLE 2-continued

| Sample No. | | Maximum Density | Glossiness: Image Recording Surface Side Glossiness Ga | Glossiness: Backing Layer Surface Side Glossiness Gb | Glossiness: Glossiness Difference (\|Gb − Ga\|) | Error Ratio | Remarks |
|---|---|---|---|---|---|---|---|
| 13 | Cellulose acetate butyrate (CAB381-20) 0.5 g/m$^2$ Cellulose acetate propionate (CAP482-0.5*) 1.8 g/m$^2$ | 4.9 | 63 | 83 | 20 | 0% | Inv. |

Inv.: Present Invention
*CAB381-20, CAP504-0.2, and CAP482-0.5: manufactured by Eastman Chemicals Co.

The present invention makes it possible to provide a photothermographic recording material which exhibits excellent distinguishability between the front and the back surface and enhances efficiency of press plate making work.

What is claimed is:

1. A photothermographic recording material comprising on one side of a support an image recording layer comprising a light-insensitive organic silver salt, a photosensitive silver halide, a reducing agent for silver ions and a binder, wherein the difference in specular glossiness at an angle of 60° between a thermally developed exposed area of the image recording layer and the bottom support surface opposite the thermally developed exposed area is at least 15.

2. The photothermographic recording material of claim 1, wherein the specular glossiness of the thermally developed exposed area of the image recording layer is smaller than the specular glossiness of the bottom support surface opposite the thermally developed exposed area.

3. The photothermographic recording material of claim 1, wherein the image recording layer further comprises a high contrast agent represented by Formula (1), Formula (1):

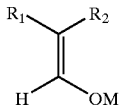

wherein each $R_1$ and $R_2$ is independently a substituent group and at least one of $R_1$ and $R_2$ represents a cyano group; and M represents H or an alkali metal atom.

4. The photothermographic recording material of claim 1, wherein the image recording layer further comprises a high contrast agent represented by Formula (2), Formula (2):

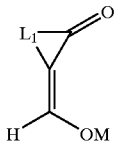

wherein $L_1$ represents a divalent organic group which is capable of forming a ring; and M represents H or an alkali metal atom.

5. The photothermographic recording material of claim 1, wherein the recording material further comprises an adjacent layer in direct contact with the image recording layer, and at least one of the image recording layer and the adjacent layer comprises a high contrast agent represented by Formula (1), Formula (1):

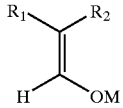

wherein each $R_1$ and $R_2$ is independently a substituent group and at least one of $R_1$ and $R_2$ represents a cyano group; and M represents H or an alkali metal atom.

6. The photothermographic recording material of claim 1, wherein the recording material further comprises an adjacent layer in direct contact with the image recording layer, and at least one of the image recording layer and the second layer comprises a high contrast agent represented by Formula (2), Formula (2):

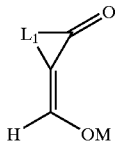

wherein $L_1$ represents a divalent organic group which is capable of forming a ring; and M represents H or an alkali metal atom.

* * * * *